US010773516B2

(12) United States Patent
Mizutani

(10) Patent No.: US 10,773,516 B2
(45) Date of Patent: Sep. 15, 2020

(54) INK JET RECORDING APPARATUS AND METHOD FOR DETECTING DEFECTIVE NOZZLE

(71) Applicant: Konica Minolta, Inc., Tokyo (JP)

(72) Inventor: Toshiyuki Mizutani, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/330,210

(22) PCT Filed: Sep. 13, 2017

(86) PCT No.: PCT/JP2017/033089
§ 371 (c)(1),
(2) Date: Mar. 4, 2019

(87) PCT Pub. No.: WO2018/052031
PCT Pub. Date: Mar. 22, 2018

(65) Prior Publication Data

US 2019/0224964 A1 Jul. 25, 2019

(30) Foreign Application Priority Data

Sep. 14, 2016 (JP) ..... 2016-179135

(51) Int. Cl.
*B41J 2/045* (2006.01)
*B41J 2/21* (2006.01)
*B41J 29/393* (2006.01)

(52) U.S. Cl.
CPC ..... *B41J 2/0451* (2013.01); *B41J 2/04581* (2013.01); *B41J 2/2103* (2013.01);
(Continued)

(58) Field of Classification Search
CPC ..... B41J 2/0451; B41J 2/0452; B41J 29/393; B41J 2/2146; B41J 2/2103; B41J 2/04581; B41J 2/2139; B41J 2029/3935
See application file for complete search history.

(56) References Cited

U.S. PATENT DOCUMENTS

2012/0154477 A1* 6/2012 Yamazaki ..... B41J 2/2139 347/19
2012/0154837 A1* 6/2012 Yamazaki ..... B41J 2/2142 358/1.9

FOREIGN PATENT DOCUMENTS

EP 2623324 A2 8/2013
EP 3368322 A1 9/2018
(Continued)

OTHER PUBLICATIONS

Written Opinion of the International Searching Authority dated Oct. 24, 2017 from the corresponding International Application No. PCT/JP2017/033089 and English translation.
EPO, Extended European Search Report for the corresponding European patent Application No. 17850932.9, dated Aug. 1, 2019 (10 pages).
(Continued)

*Primary Examiner* — Sharon A. Polk
(74) *Attorney, Agent, or Firm* — Lucas & Mercanti, LLP

(57) ABSTRACT

An ink jet recording apparatus includes an ink discharger provided with a plurality of nozzles which discharge ink; and a processor. The processor discharges ink onto a recording medium from the plurality of nozzles of the ink discharger, and uses the ink discharger to record on the recording medium a composite test image including a halftone image with a predetermined density and a defective nozzle specifying image which specifies a defective nozzle in which a defect in ink discharge is occurring. The processor obtains information regarding the defect in the ink discharge from the nozzle based on a density distribution of the halftone image read from read data of the composite test
(Continued)

image and specifies a defective nozzle based on the above information and a portion in the defective nozzle specifying image of the read data.

16 Claims, 6 Drawing Sheets

(52) U.S. Cl.
CPC ..... *B41J 2/2142* (2013.01); *B41J 2/2146* (2013.01); *B41J 29/393* (2013.01); *B41J 2/2139* (2013.01); *B41J 2029/3935* (2013.01)

(56) References Cited

FOREIGN PATENT DOCUMENTS

| | | | |
|---|---|---|---|
| JP | 2011-201051 | A | 10/2011 |
| JP | 2015-58602 | A | 3/2015 |
| JP | 2016-159581 | A | 6/2016 |

OTHER PUBLICATIONS

International Search Report dated Oct. 24, 2017 from the corresponding International Application No. PCT/JP2017/033089 and English translation.
CNIPA, Office Action for the corresponding Chinese patent Application No. 201780056238.8, dated Apr. 10, 2020, with English translation (17 pages).

* cited by examiner

INK JET RECORDING APPARATUS AND METHOD FOR DETECTING DEFECTIVE NOZZLE

This is the US National Stage of Application No. PCT/JP2017/033089 filed on Sep. 13, 2017. Japanese Patent Application No. 2016-179135 filed on Sep. 14, 2016 including description, claims, drawings, and abstract, the entire disclosure is incorporated herein by reference in its entirety.

TECHNOLOGICAL FIELD

The present invention relates to an ink jet recording apparatus and a method for detecting a defective nozzle.

BACKGROUND ART

There is an ink jet recording apparatus which discharges ink from a plurality of nozzles provided in an ink discharger and lands the ink in a desired position on the recording medium in order to record an image. According to such ink jet recording apparatus, defects in ink discharge from the nozzle results in decrease in image quality of the recorded image. Therefore, conventionally, an examination to detect the defective nozzle in which defects in ink discharge is occurring is periodically performed. As one examination method, there is a method to discharge ink from a plurality of nozzles of the ink discharger onto the recording medium to form a dot and a line corresponding to each nozzle, and analyzing the read data of the dot and the line (for example, patent document 1). According to such method, when the position, interval, size, thickness, and density of the dot or line which is read does not satisfy a predetermined standard, the nozzle corresponding to the dot and the line may be detected as the defective nozzle.

PRIOR ART DOCUMENT

Patent Document

Patent Document 1: Japanese Patent Application Laid-Open Publication No. 2011-201051

SUMMARY

Problems to be Solved by the Invention

However, when the above-described predetermined standard is not satisfied, this does not always mean that the image quality of the recorded image is substantially decreased. Therefore, there is a problem that it is not easy to suitably and correctly detect and specify the defective nozzle according to a simple detection method based on determining whether a unified standard is satisfied.

The purpose of the present invention is to provide an ink jet recording apparatus which can specify a defective nozzle more suitably and a method for detecting a defective nozzle.

Means for Solving the Problem

To achieve at least one of the abovementioned objects, according to an aspect of the present invention, an ink jet recording apparatus reflecting one aspect of the present invention includes, an ink discharger provided with a plurality of nozzles which discharge ink;

a recording controller which discharges ink onto a recording medium from the plurality of nozzles of the ink discharger, and which uses the ink discharger to record on the recording medium a composite test image including a halftone image with a predetermined density and a defective nozzle specifying image which specifies a defective nozzle in which a defect in ink discharge is occurring; and a defective nozzle specifier which obtains information regarding the defect in the ink discharge from the nozzle based on a density distribution of the halftone image read from read data of the composite test image and which specifies a defective nozzle based on the above information and a portion in the defective nozzle specifying image of the read data.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

EMBODIMENT FOR CARRYING OUT THE INVENTION

Hereinafter, one or more embodiments of the present invention will be described with reference to the drawings. However, the scope of the invention is not limited to the disclosed embodiments.

The embodiments regarding the ink jet recording apparatus and the method to detect the defective nozzle according to the present invention are described based on the drawings.

Figure 1:
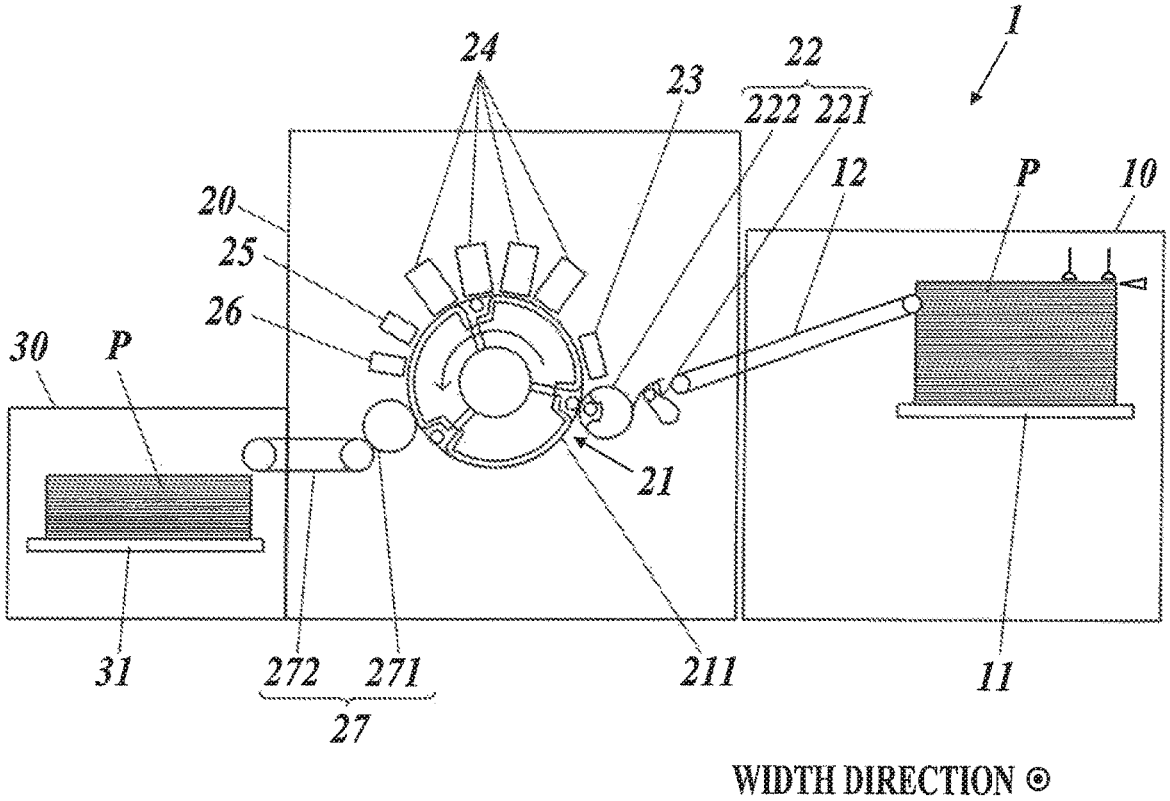
FIG. 1 is a diagram showing a schematic configuration of the ink jet recording apparatus.

FIG. 1 is a diagram showing a schematic configuration of the ink jet recording apparatus 1 according to an embodiment of the present invention.

Figure 3:
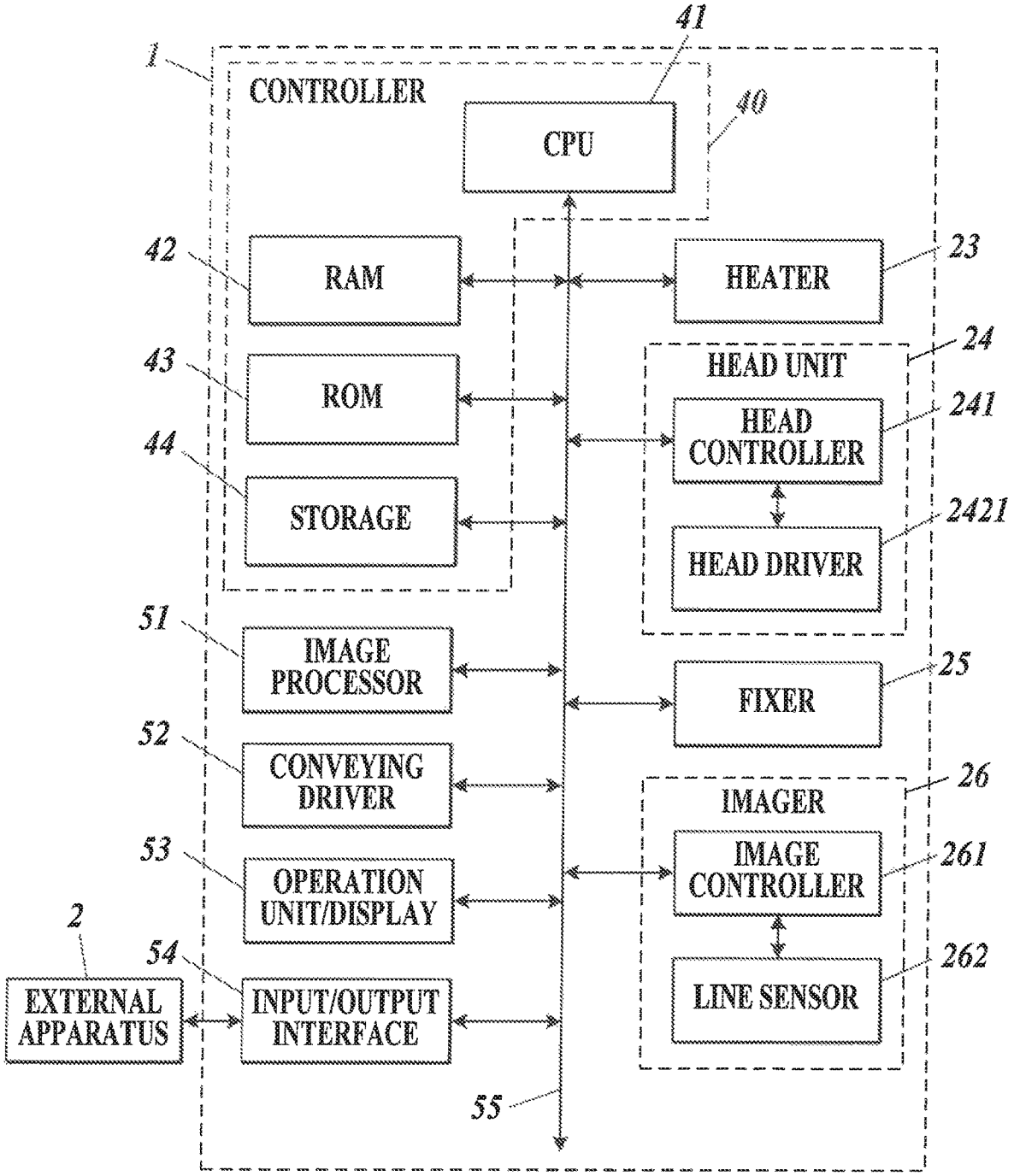
FIG. 3 is a block diagram showing a configuration of main functions in the ink jet recording apparatus.

The ink jet recording apparatus 1 includes a sheet feeder 10, an image recorder 20, a sheet ejector 30, and a controller 40 (FIG. 3). In the ink jet recording apparatus 1, under the control by the controller 40, a recording medium P stored in the sheet feeder 10 is conveyed to the image recorder 20, an image (ink jet image) is recorded on the recording medium P in the image recorder 20, and the recording medium P on which the image is recorded is conveyed to the sheet ejector 30. As the recording medium P, in addition to paper such as normal paper and coated paper, various media in which ink landed on its surface can be fixed may be used, examples including fabric or resin shaped in a sheet.

The sheet feeder 10 includes a sheet feeding tray 11 which stores the recording medium P. and a medium supplier 12 which conveys and supplies the recording medium P from the sheet feeding tray 11 to the image recorder 20. The medium supplier 12 includes a belt in a loop shape in which the internal side is supported by two rollers. When the roller is rotated in the state with the recording medium P placed on the belt, the recording medium P is conveyed from the sheet feeding tray 11 to the image recorder 20.

The image recorder 20 includes a conveyor 21, a transfer unit 22, a heater 23, a head unit 24 (ink discharger), a fixer 25, an imager 26 (reader) and a delivering unit 27.

The conveyor 21 holds the recording medium P placed on the conveying surface (outer circumferential surface) of a cylinder-shaped conveying drum 211, and the conveying drum 211 rotates and moves around the rotating axis (cylinder axis) extending in the width direction orthogonal to the diagram as shown in FIG. 1. With this, the conveyor 21 conveys the conveying drum 211 and the recording medium P on the conveying drum 211 in the conveying direction. The conveying drum 211 includes a nail portion and an intake unit (not shown) to hold the recording medium P on the conveying surface. The edge of the recording medium P is pressed by the nail portion, and the recording medium P is pulled toward the conveying surface by the intake unit. With this, the recording medium P is maintained on the conveying surface. The conveying unit 21 includes a conveying drum motor which is not shown to rotate the conveying drum 211, and the conveying drum 211 rotates in an angle in proportion with the rotating amount of the conveying drum motor.

The transfer unit 22 transfers the recording medium P conveyed by the medium supplier 12 of the sheet feeder 10 to the conveyor 21. The transfer unit 22 is provided in a position between the medium supplier 12 of the sheet feeder 10 and the conveyor 21. The transfer unit 21 uses a swing arm 221 to hold and pull up an edge of the recording medium P conveyed from the medium supplier 12 and transfers the recording medium P to a transfer drum 222 and then to the conveyor 21.

The heater 23 is provided between the position of the transfer drum 222 and the position of the head unit 24, and heats the recording medium P so that the recording medium P conveyed by the conveyor 21 is a temperature within a predetermined temperature range. The heater 23, for example, includes an infrared heater and conducts the infrared heater based on the control signal supplied from the controller 40 (FIG. 3) to heat the infrared heater.

The head unit 24 records the image by performing a recording operation in which ink is discharged to the recording medium P from the nozzle opening provided in the ink discharging surface facing the conveying surface of the conveying drum 211 at the suitable timing according to the rotation of the conveying drum 211 which holds the recording medium P. The head unit 24 is positioned so that the ink discharge surface and the conveying surface are separated a predetermined distance. The ink jet recording apparatus 1 according to the present embodiment includes 4 head units 24 corresponding to the following 4 colors of ink, yellow (Y), magenta (M), cyan (C), and black (K), and the 4 head units 24 are arranged to be aligned with a predetermined interval in between in the following order, the colors Y, M, C, K from the upstream side of the conveying direction of the recording medium P.

Figure 2:
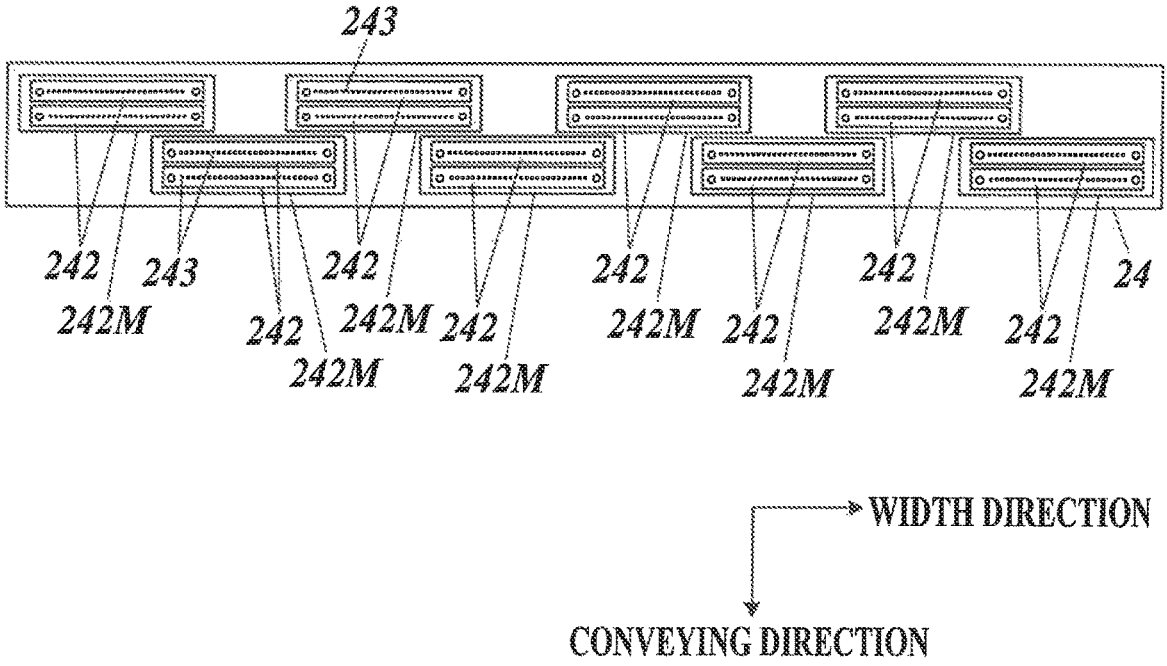
FIG. 2 is a schematic diagram showing a configuration of a head unit.

FIG. 2 is a diagram showing a schematic view of the configuration of the head unit 24. FIG. 2 is a planar view which views the entire head unit 24 from the side opposite of the conveying surface of the conveying drum 211.

According to the present embodiment, the head unit 24 includes 16 head units 242 arranged so that a plurality of recording elements which discharge ink are arranged in the width direction. Each recording element includes, a pressure chamber which stores ink, a piezoelectric element provided on a wall surface of the pressure chamber, an electrode which adds voltage to the piezoelectric element to cause an electric field and a nozzle 243 which is communicated with the pressure chamber and discharges ink in the pressure chamber. When the driving signal to deform the piezoelectric element is input, the pressure chamber is deformed by the deformed piezoelectric element and the pressure in the pressure chamber changes. Then, the recording element discharges ink from the nozzle 243 in communication with the pressure chamber. The amount of ink discharged from the nozzle 243 can be adjusted by changing the amplitude of the voltage of the driving signal. FIG. 2 shows a position of the ink discharge port of the nozzle 243 which is a configuration element of the recording element. The array direction of the recording element in the recording head 242 is not limited to the width direction orthogonal to the conveying direction, and can be a direction which intersects with the conveying direction in an angle other than a right angle.

In the head unit 24, 2 among 16 recording heads 242 are grouped, and 8 head modules 242M consisting of the groups of recording heads 242 are provided. In each head module 242M, the 2 recording heads 242 are positioned in a relation so that the nozzles 243 of the 2 recording heads 242 are positioned alternately in the width direction. By arranging the recording elements in this way, recording can be performed with the resolution of 1200 dpi (dot per inch) in the width direction using each head module 242M.

The 8 head modules 242M form a line head by being positioned in a zigzag form with the positioning ranges partially overlapping in the width direction in a relation so that the positioning range of the nozzles 243 in the width direction include ranges different from each other and the nozzles 243 are positioned throughout the predetermined recording width in the entire width direction for each of the 8 head modules 242M. According to the above positions of the zigzag head modules 242M, a portion of the positioning ranges of the nozzles 243 in the width direction in a nearby pair of head modules 242M are set to overlap. In such overlapping ranges in which the positioning ranges of the nozzles 243 overlap, ink is discharged from the nozzles 243 belonging to either one of the pair of head modules 242M in each position in the width direction.

The positioning range of the nozzle 243 included in the head unit 24 in the width direction covers the width in the width direction of the region in which the image can be recorded on the recording medium P conveyed by the conveying unit 21. The head unit 24 is used with the position fixed when the image is recorded, and ink is successively discharged at a predetermined interval (conveying direction interval) in different positions in the conveying direction according to the conveying of the recording medium P. The head unit 24 records the image in a single pass method. According to the present embodiment, the conveying direction interval is the interval in which the recording resolution in the conveying direction becomes 1200 dpi.

Instead of the above configuration, the head unit 24 may consist of a single recording head 242.

In the recording head 242, a defective nozzle with defects in discharging ink may appear due to variation in the process of forming the nozzle 243, variation in the characteristics of the piezoelectric element, clogging in the nozzle 243 or blocking of the nozzle opening by attached foreign matter. Defects in ink discharge include, no discharge of ink, an abnormality in the ink discharging direction (flying direction of the discharged ink droplet), an abnormality in the ink discharge amount (volume of the discharged ink droplet), and an abnormality in the speed of the discharged ink droplet. When the head unit 24 performs a recording operation when there is a defective nozzle, the landing position and the amount of the ink discharged from the defective nozzle is shifted from the original setting. This results in decrease of the image quality of the image recorded on the recording medium P. The method to detect the defects in ink discharge from the nozzle 243 and the method to adjust the ink discharging operation of the nozzle 243 when the ink discharge defect is detected are described later.

Ink including a nature in which the phase changes to gel-form or sol-form according to temperature and which hardens by irradiating energy rays such as ultraviolet rays is used as the ink discharged from the nozzle 243 of the recording element.

According to the present embodiment, ink which is in gel-form in room temperature and which changes to sol-form when heated is used. The head unit 24 includes an ink heater (not shown) which heats the ink stored in the head unit 24. The ink heater operates under the control by the controller 40, and heats the ink to the temperature that the ink changes to sol-form. The recording head 242 discharges the ink heated to sol-form. When the ink in sol-form is discharged to the recording medium P, after the ink droplet lands on the recording medium P, the ink is cooled naturally to be immediately changed to gel-form and the ink solidifies on the recording medium P.

The fixer 25 includes an energy ray irradiating unit positioned throughout the width in the width direction of the conveyor 21. The fixer 25 irradiates energy rays such as an ultraviolet ray from the energy irradiating unit to the recording medium P placed on the conveyor 21 and hardens and fixes the ink discharged on the recording medium P. The energy ray irradiating unit of the fixer 25 is positioned facing the conveying surface in a position between the position of the head unit 24 and the position of the transfer drum 271 of the delivering unit 27 in the conveying direction.

The imager 26 is positioned to be able to read the surface of the recording medium P on the conveying surface in the position between the fixing position of the ink by the fixer 25 and the position of the transfer drum 271 in the conveying direction. The imager 26 reads the image recorded on the recording medium P conveyed by the conveying drum 211 within the predetermined reading range and outputs imaged data (read data) of the image.

According to the present embodiment, the imager 26 includes an optical source which irradiates light on the recording medium P conveyed by the conveying drum 211 and a line sensor 262 (FIG. 3) in which image elements which detect the strength of the reflected light which entered the recording medium P are arranged in the width direction. Specifically, the line sensor 262 is provided with three lines of imaging element lines including the imaging elements arranged in the width direction. Signals according to the strength of the wavelength component of R (red), G (green), and B (blue) of the entering light is output by the imaging elements of the imaging element lines. For example, a device in which a color filter which transmits light with the wavelength component of R, G, or B is positioned in the light receiving portion of a CCD (Charge Coupled Device) sensor or CMOS (Complementary Metal Oxide Semiconductor) sensor provided with a photodiode as the photoelectric conversion element can be used as the imaging element corresponding to R, G, B. The reading resolution by each imaging element of the line sensor 262 may be 600 dpi in the width direction, for example. That is, the image sensor can be an image obtained at a resolution lower than the resolution corresponding to the interval arranged between the recording elements. The output timing of the signal from the line sensor 262 is adjusted so that the reading resolution in the conveying direction is 600 dpi.

The signal output from the line sensor 262 is output to the controller 40 as the imaged data by the imaging controller 261 (FIG. 3).

The configuration of the imager 26 is not limited to the above, and an area sensor can be used instead of the line sensor 262.

The delivering unit 27 includes a belt loop 272 including a belt in a ring shape supported by two rollers on the inner side and a cylinder-shaped transfer drum 271 which transfers the recording medium P to the belt loop 272 from the conveyor 21. The delivering unit 27 uses the belt loop 272 to convey the recording medium P transferred from the conveyor 21 onto the belt loop 272 by the transfer drum 271 and sends the recording medium P to the sheet ejector 30.

The sheet ejector 30 includes a plate-shaped sheet ejecting tray 31 on which the recording medium P sent from the image recorder 20 by the delivering unit 27 is placed.

FIG. 3 is a block diagram showing a configuration of the main functions in the ink jet recording apparatus 1.

The ink jet recording apparatus 1 includes a heater 23, a head unit 24 including a head controller 241 and a head driver 2421, a fixer 25, an imager 26 including an image controller 261 and a line sensor 262, a controller 40 (recording controller, defective nozzle specifier, adjuster), an image processor 51, a conveying driver 52, an operation unit/display 53, an input/output interface 54, and a bus 55.

The head controller 241 outputs various control signals and image data to the head driver 2421 provided in the head module 242M at a suitable timing according to the control signal from the controller 40.

The head driver 2421 supplies driving signals which deform the piezoelectric element to the recording element of the 2 recording heads 242 in the head module 242M according to the control signal and the image data input from the head controller 241, and discharges the ink from the opening of each nozzle 243.

The imaging controller 261 images the image on the recording medium P with the line sensor 262 based on the control signal input from the controller 40. The image controller 261 performs processing on the signal output from the line sensor 262 by imaging. The processes include current/voltage conversion, amplification, noise removal, and analog/digital conversion. The imaging controller 261 outputs to the controller 40 the processed signal as imaged data showing a brightness value of the read data.

The controller 40 includes a CPU 41 (Central Processing Unit), a RAM 42 (Random Access Memory), a ROM 43 (Read Only Memory), and a storage 44.

The CPU 41 reads the various controlling programs and setting data stored in the ROM 43 and stores the above in the RAM 42 to execute the programs and perform various calculating processes. The CPU 41 centrally controls the entire operation of the ink jet recording apparatus 1.

The RAM 42 provides a work memory space in the CPU 41 to store temporary data. The RAM 42 may be included in the nonvolatile memory.

The ROM 43 stores various controlling programs and setting data executed by the CPU 41. Instead of the ROM 43, an EEPROM (Electrically Erasable Programmable Read Only Memory) or a rewritable nonvolatile memory such as a flash memory can be used.

The storage 44 stores a print job (image recording instruction) input from the external apparatus 2 through the input/ output interface 54 and image data of a normal image as a recording target in the print job, later-described image data for a composite test image, imaged data generated by the imager 26, and image data after image processes by the image processor 51 on various image data. For example, an HDD (Hard Disk Drive) is used as the storage 44, and a DRAM (Dynamic Random Access Memory) can also be used together with the HDD.

The image processor 51 performs the predetermined image process on the image data stored in the storage 44 under the control by the controller 40, and stores the image data after the image process in the storage 44. The following image processes are performed by the image processor 51, a rasterizing process which converts the PDL (Page Description Language) data stored in the storage 44 input from the external apparatus 2 to a rasterized form, a conversion process which decreases the number of tones in each pixel in the image data in the rasterized form, a dividing process which divides image data into portion image data corresponding to each head module 242M, and a later-described combining process which combines halftone image data and defect nozzle specifying image data. Among the above, in the conversion process to reduce the number of tones in each pixel of the image data, the halftone process is performed to convert the image data with 8 bits in each pixel (256 tones) to image data with 1 bit in each pixel (2 tones). Although the method to perform the halftone process is not limited, the following methods can be used, a random dither method which binarizes the tone value according to a random threshold in each pixel, an organized dither method which performs binarizing of the tone value in each pixel according to a threshold arranged in a matrix, and an error diffusion method which distributes the error in the binarizing process of the tone value in each pixel to surrounding pixels.

In addition to the above image processing, the image processor 51 may perform a color conversion process or a tone correction process.

The conveying driver 52 supplies a driving signal to the conveying drum motor of the conveying drum 211 based on the control signal supplied from the controller 40 and rotates the conveying drum 211 at a predetermined speed and timing. The conveying driver 52 supplies a driving signal to the motor to operate the medium supplier 12, the transfer unit 22, and the delivering unit 27 based on the control signal supplied from the controller 40, and the recording medium P is supplied to the conveyor 21 and discharged from the conveyor 21.

The operation unit/display 53 includes a display apparatus such as a liquid crystal display and an organic EL display and an input apparatus such as an operation key or a touch panel positioned overlapped on the screen of the display apparatus. The operation unit/display 53 displays various information on the display apparatus, converts the input operation of the user on the input apparatus to an operation signal, and outputs the operation signal to the controller 40.

The input/output interface 54 transmits and receives the data between the external apparatus 2 and the controller 40. The input/output interface 54 may be various serial interfaces, various parallel interfaces or a combination of the above.

The bus 55 is a path to transmit and receive the signal between the controller 40 and other configurations.

The external apparatus 2 may be a personal computer, for example, and supplies the print job and the image data through the input/output interface 54 to the controller 40.

Next, the method to detect the defective nozzle in the ink jet recording apparatus 1 according to the present embodiment is described.

In the ink jet recording apparatus 1 according to the present embodiment, the detection operation of the defective nozzle is performed when the head unit 24 is manufactured or exchanged or at the predetermined timing (for example, when a predetermined amount of images are recorded). In the defective nozzle detection operation, in response to an input operation on the operation unit/display 53 by the user or when the controller 40 determines that it is the predetermined timing, one recording medium P is used to record on the recording medium Pa predetermined test image (later described composite test image) used for detecting and specifying the defective nozzle. The test image recorded on the recording medium P is imaged by the imager 26, and the defective nozzle is detected and specified based on the obtained imaged data. When the defective nozzle is specified, the head unit 24 adjusts the operation of the ink discharge from the nozzle 243.

Figure 4:
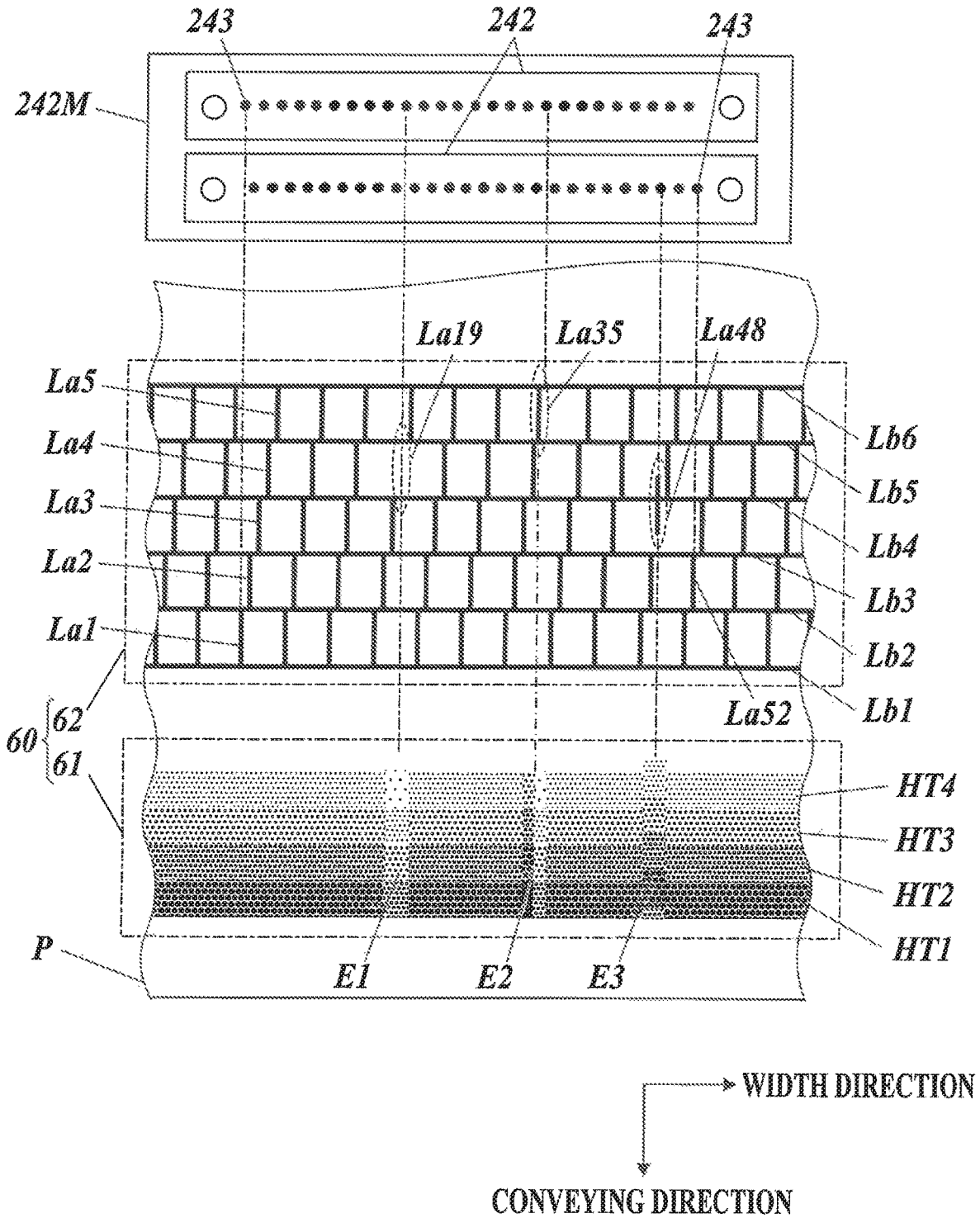
FIG. 4 is a diagram showing an example of a test image.

FIG. 4 is a diagram showing an example of a composite test image 60. In FIG. 4, the portion recorded by one head module 242M in the composite test image 60 is shown enlarged, and the recording medium P is illustrated aligned with the head module 242M so that the relation of the positions between the enlarged portion and the head module 242M can be understood. For the purpose of description, the number of nozzles 243 in the head module 242M shown in FIG. 4 is reduced to 52.

The composite test image 60 includes a half tone image 61 and a defective nozzle specifying image 62. The composite test image 60 is recorded based on the composite test image data combining the image data of the halftone image 61 (half tone image data) with the image data of the defective nozzle specifying image 62 (defective nozzle specifying image data).

The defective test image 60 is recorded for each of the 4 head units 24 in different regions on the recording medium P or on a different recording medium P.

The halftone image 61 includes 4 halftone regions HT1 to HT4 with densities different from each other. Each of the halftone regions HT1 to HT4 is an image showing a halftone with a certain density to easily determine the contrast in the shade. The halftone is expressed according to the number of dots formed by ink discharge from the nozzle 243 for each unit area. For example, the halftone is defined by the percentage of the pixel with the dot formed in the unit region of the unit area corresponding to 256 pixels×256 pixels set as the unit region to express each color of the 256 tones. In this case, 30% halftone means dots are formed in 19660 pixels among 256×256 pixels (65536 pixels). According to the present embodiment, the form of expression showing the halftone according to the number of dots formed for each unit area is described as the pseudo halftone form. The halftone image 61 in the pseudo halftone form is recorded based on the halftone image data generated by the image processor 51 performing the halftone process such as the dither method or the error diffusion method as described above.

According to the present embodiment, the halftone image 61 is recorded by the pseudo halftone form which is the same as the pseudo halftone form in the normal image of the print job. That is, data processed by the image processor 51 with the halftone process using the same algorithm is applied as the halftone image data and the image data used in recording the normal image.

When a defective nozzle is already specified when the detection operation of the defective nozzle starts (that is, when a defective nozzle is specified in previous defective nozzle detection operations), the halftone image 61 is recorded with a correction process to suppress the decrease in the image quality due to the defective nozzle, for example, a later described complemented correction, a delay correction, and a shading correction. With this, the defective nozzle which newly appeared after finishing the previous detective operation is detected based on the halftone image 61.

According to the ink jet recording apparatus 1, whether or not there is color unevenness is detected based on the density distribution of the halftone image 61 read from the data of the halftone image 61 imaged by the imager 26. When there is a defective nozzle in the head unit 24 and the amount or the landing position of the ink that lands becomes unsuitable due to the ink not being discharged from the defective nozzle, the abnormality in the ink discharging direction and the abnormality in the ink discharge amount, the halftone density changes from the original density and color unevenness occurs in the halftone image 61. Such color unevenness is one type of the recording defective portion which appears as the influence of the ink discharge defect in the halftone image 61. For example, when there is a defective nozzle which does not discharge ink, as shown in FIG. 4, the density of the halftone image decreases and color unevenness E1 in which the density is lower than the surroundings occurs. When there is a defective nozzle in which the ink discharge direction is shifted in the width direction, color unevenness E2 due to a local density change in the halftone occurs according to the position shift. When there is a defective nozzle in which the landing position of the ink is shifted in the conveying direction due to an abnormality in the ink discharge direction in the conveying direction or an abnormality in the ink discharge speed, color unevenness E3 due to density unevenness of the halftone in the conveying direction occurs according to the shift.

As described above, since the imaging resolution of the line sensor 262 of the imager 26 is coarse than the nozzle array, in the imaged data of the halftone image 61, the representative value of the density in each imaging region which can be discriminated by the imager 26 is shown. Therefore, the color unevenness E is detected as the region of the range corresponding to the plurality of nozzles 243.

The defective nozzle specifying image 62 includes a plurality of lines La (nozzle corresponding sign) and 6 reference lines Lb (Lb1 to Lb6) extending in the width direction and recorded in an even interval in the conveying direction.

Each of the plurality of lines La is recorded by discharging ink continuously from one nozzle 243 to the recording medium P conveyed in the conveying direction. FIG. 4 shows each line La recorded by the 1st to 52nd recording element from the left side in the head module 242M as lines La1 to La52. In the defective nozzle specifying image 62, in each belt shaped region extending in the width direction between two adjacent reference lines Lb, a plurality of lines La recorded by every 4 nozzles 243 are arranged. In the belt shaped region adjacent in the conveying direction, the nozzle 243 which records the line La is shifted one by one. Specifically, in the belt shaped region between the reference line Lb1 and the reference line Lb2, lines La1, La6, La11, . . . are recorded, in the belt shaped region between the reference line Lb2 and the reference line Lb3, lines La2, La7, La12, . . . are recorded, and similarly after, the nozzle 243 used for recording the line La is shifted by one for each belt-shaped region, and in the belt-shaped region between the reference line Lb5 and the reference line Lb6, lines La5, La10, La15, . . . are recorded. Each line La is in contact with two reference lines Lb recorded above and below the line La and is recorded so as not to project from each reference line Lb.

By analyzing the imaged data of the defective nozzle specifying image 62 imaged by the imager 26, the defective nozzle in which the ink discharge defect is occurring can be detected and specified.

For example, as in the line La19 shown in FIG. 4, when the line La is not recorded within the predetermined range corresponding to the position of the nozzle 243, the nozzle 243 corresponding to the line La is specified as the defective nozzle which does not discharge ink.

Moreover, as in the line La35 shown in FIG. 4, when the line La is recorded in the position shifted in the width direction from the predetermined position corresponding to the position of the nozzle 243, the nozzle 243 corresponding to the line La is specified as the defective nozzle including the abnormality in the ink discharge direction in the width direction (that is, the landing position of the ink in the width direction).

As described above, when the defective nozzle which does not discharge ink or the defective nozzle in which the ink landing position is abnormal in the width direction is specified, for example, the image data is corrected so that the defective nozzle is set so as not to discharge ink, and the ink which should be discharged from the defective nozzle is complemented by increasing the discharged ink amount from the nozzle 243 near the defective nozzle. According to this description, such correction of the image data is referred to as complemented correction.

As in the line La48 shown in FIG. 4, when the line La is shifted in the conveying direction and is projected from the reference line Lb, the nozzle 243 corresponding to the line La is specified as the defective nozzle including the abnormality in the ink discharge direction in the conveying direction or the ink speed (that is, the ink landing position in the conveying direction).

As described above, when the defective nozzle with the ink landing position abnormality in the conveying direction is specified, the ink discharge timing from the defective nozzle is adjusted based on the projected amount and the projected direction that the line La projects from the reference line Lb, for example. The adjustment of the ink discharge timing can be performed by correcting the row data corresponding to the defective nozzle in the image data regarding the recorded image to be shifted in the number of pixels according to the shift in the landing position, for example. According to this description, such correction of image data is described as delay correction.

The defective nozzle including the abnormality in the ink discharge amount from the nozzle 243 can be detected based on the line width and density of the line La. When such defective nozzle is detected, the ink discharge amount from the nozzle 243 is adjusted according to the detected result to perform shading correction which evens the density of the nozzles 243.

Preferably, the ink discharge state of each nozzle 243 is reflected as is on the line La in the defective nozzle specifying image 62. Therefore, even if there is a defective nozzle already specified when the defective nozzle detection operation starts, the defective nozzle specifying image 62 is recorded without performing the correction process such as the complemented correction, the delay correction, and the shading correction.

According to the defective nozzle detection operation of the present embodiment, after the halftone image 61 is recorded and before the image other than the halftone image 61 and the defective nozzle specifying image 62 is recorded, the defective nozzle specifying image 62 is recorded in the region adjacent to the halftone image 61 in the conveying direction. That is, right after the halftone image 61 is recorded, the defective nozzle specifying image 62 is recorded successively. Alternatively, the halftone image 61 may be recorded after recording the defective nozzle specifying image 62.

Then, the entire composite test image 60 including the halftone image 61 and the defective nozzle specifying image 62 is imaged by the imager 26. Based on the imaged data, first the information regarding the ink discharge defect from the nozzle 243 is obtained based on the density distribution of the halftone image 61. Then, the defective nozzle is specified based on this information and the portion regarding the defective nozzle specifying image 62 in the imaged data. That is, first, the detection of the color unevenness E is performed based on the density distribution of the halftone image 61 to determine whether there is a defective nozzle. When there is a defective nozzle, the region of the color unevenness E is specified as the recording defect portion. Then, based on the portion regarding the defective nozzle specifying image 62 in the image data, the line La in the range corresponding to the color unevenness E specified in the halftone image 61 (that is, the range recorded by the plurality of nozzles 243 corresponding to the color unevenness E in the defective nozzle specifying image 62) is analyzed in the defective nozzle specifying image 62. Then, the defective nozzle is detected and specified from the nozzle 243 corresponding to the range.

Next, the process of control by the controller 40 (CPU 41) regarding the defective nozzle detecting process, the composite test image data generating process, and the image recording process performed in the ink jet recording apparatus 1 are described.

Figure 5:
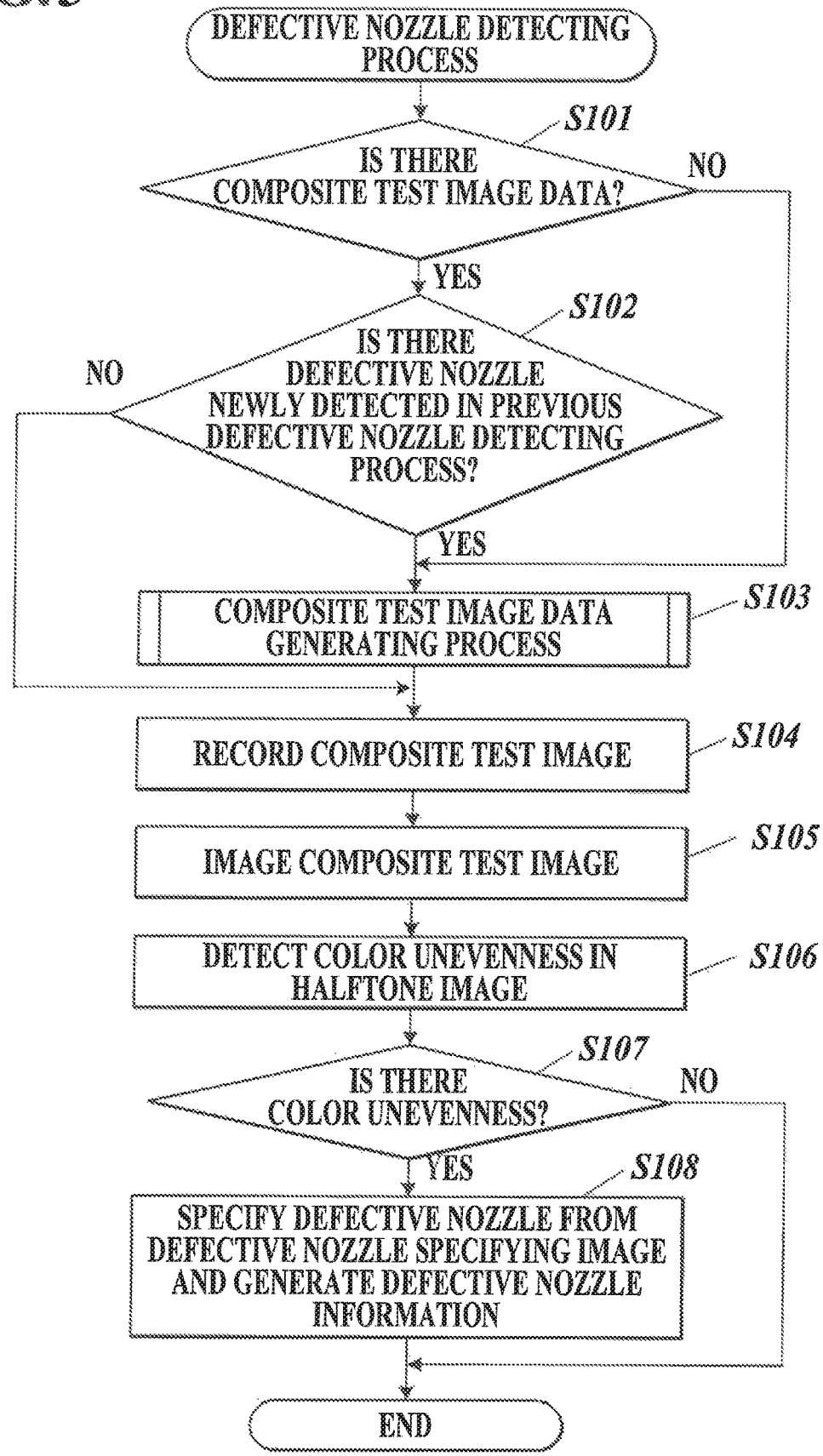
FIG. 5 is a flowchart showing a control process in a defective nozzle detecting process.

FIG. 5 is a flowchart showing a control process by the controller 40 regarding the defective nozzle detecting process.

The defective nozzle detecting process is performed in the following situations, for example, when the user performs a predetermined input operation on the operation unit/display 53 to instruct detection of the defective nozzle when the apparatus is shipped from the factory or when the head unit 24 is exchanged, or when it is a predetermined timing to perform the detection of the defective nozzle (for example, after the defective nozzle detecting process performed the latest ends, a predetermined number of images is recorded or a preset interval term passes).

When the defective nozzle detecting process starts, the controller 40 determines whether the composite test image data which is already generated is stored in the storage 44 (step S101).

When it is determined that the composite image data is stored in the storage 44 ("YES" in step S101), the controller 40 determines whether the defective nozzle is newly detected in the previous defective nozzle detecting process (step S102). When it is determined that the defective nozzle is newly detected ("YES" in step S102), the controller 40 performs the later described composite test image data generating process (step S103) and newly generates the composite test image data to be stored in the storage 44.

When it is determined that the composite test image data is not stored in the storage 44 in the process in step S101, that is, when it is determined that this is the first defective nozzle detecting process ("NO" in step S101), the controller 40 does not perform the determination of step S102 and performs the composite test image data generating process (step S103).

When the composite test image data is generated, the controller 40 records the composite test image 60 on the recording medium P using the head unit 24 (step S104: recording step). Here, the controller 40 controls the conveying driver 52 to output the driving signal to the conveying drum motor of the conveying drum 211 to start the rotating operation of the conveying drum 211. Moreover, the controller 40 outputs the control signal to the conveying driver 52 to operate the sheet feeder 10, the transfer unit 22 and the conveyor 21 in order to place the recording medium P on the conveying surface of the conveying drum 211. Next, the controller 40 controls the head controller 241 to supply to the head modules 242M (head driver 2421) the composite test image data stored in the storage 44 and the control signal at a suitable timing according to the rotation of the conveying drum 211. With this, the ink is discharged from the nozzle 243 of each recording head 242 to the recording medium P and the composite test image 60 is recorded on the recording medium P. With this, right after the halftone image 61 is recorded on the recording medium P the defective nozzle specifying image 62 is successively recorded on the same recording medium P.

Moreover, the controller 40 controls the fixer 25 to irradiate the predetermined energy ray to the ink at the timing that the recording medium P with the ink applied is moved to the position of the fixer 25 so that the ink is fixed on the recording medium P.

In the process in step S102, when it is determined that the defective nozzle is not newly detected in the previous defective nozzle detecting process ("NO" in step S102), the controller 40 does not perform the composite test image data generating process in step S103, and performs the process in step S104 using the composite test image data used in the previous defective nozzle detecting process.

The controller 40 controls the imager 26 to image the composite test image 60 on the recording medium P (step S105). That is, the controller 40 outputs the control signal to the image controller 261 at the timing that the composite test image 60 on the recording medium P moves according to the rotation of the conveying drum 211 to the imaging position imaged by the imager 26, and the imaging of the composite test image 60 by the imager 26 starts. The image controller 261 repeatedly obtains the signal from the line sensor 262 at a predetermined time interval and generates the imaged data of the composite test image 60 to be stored in the storage 44.

The controller 40 detects the color unevenness E in the halftone image 61 based on the imaged data of the composite test image 60 (step S106). For example, the controller 40 determines that there is the color unevenness E when there is a portion with a pixel value that exceeds the range of predetermined allowed variation in the average value of the pixel value (brightness data) in the halftone region in each of the halftone regions HT1 to HT4 in the halftone image 61. The controller 40 specifies the region with the color unevenness E in the halftone regions HT1 to HT4 as the recording defect portion.

When it is determined that there is a color unevenness E in the halftone image 61 ("YES" in step S107), the controller 40 specifies the defective nozzle from the defective nozzle specifying image 62 in the imaged data and generates defective nozzle information (step S108). In this step, the controller 40 analyzes the plurality of lines La corresponding to the region of the color unevenness E specified in step S106 in the imaged defective nozzle specifying image 62 using the above-described method, and specifies the line La reflecting the ink discharge defect and the defective nozzle corresponding to the line La. Then, the controller 40 generates the defective nozzle information showing the arrangement number in the recording head 242 of the defective nozzle and the type of ink discharge defect (no discharge of ink, abnormality of discharge direction in width direction, abnormality of landing position in conveying direction, etc.) and the degree of the ink discharge defect (amount of shift in the landing position, etc.) and stores the information in the storage 44.

According to the present embodiment, the defective nozzle specifying step includes step S106 to step S108.

After the process in step S108 ends, or when it is determined that there is no color unevenness in the halftone image 61 ("NO" in step S107), the controller 40 ends the defective nozzle detecting process.

Figure 6:
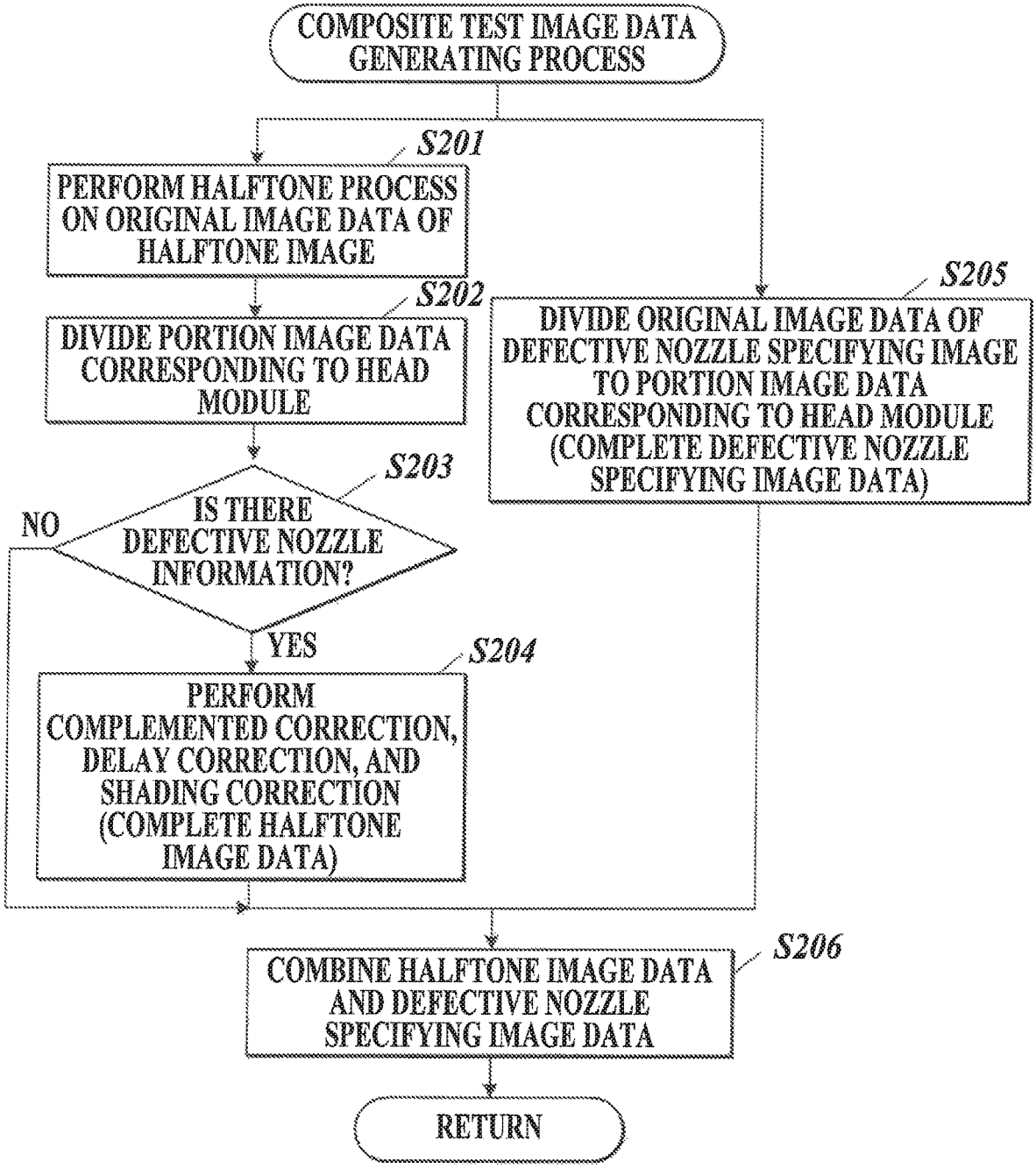
FIG. 6 is a flowchart showing a control process in a composite test image data generating process.

FIG. 6 is a flowchart showing a control process in the composite test image data generating process called in the defective nozzle detecting process.

When the composite test image data generating process starts, the controller 40 outputs the control signal to the image processor 51 so that the image processor 51 performs the halftone process on the original image data of the halftone image 61 (step S201). Here, according to the control signal from the controller 40, the image processor 51 uses the original image data in 8 bits in the halftone image 61 stored in the storage 44 in advance to generate the halftone image data with 1 bit in each pixel in the pseudo halftone form by the predetermined halftone algorithm in the above-described methods such as random dither method, organized dither method, and error diffusion method.

The controller 40 controls the image processor 51 to perform the dividing process on the halftone image data after the halftone process and generates the portion image data corresponding to each head module 242M (step S202). In this dividing process, the image data of the halftone image data before dividing is distributed in the portion image data supplied to each head module 242M so that the ink is discharged from the nozzle 243 belonging to either one of the head modules 242M in positions in the width direction in the overlapping range in the nozzle 243 in the boundary of the head modules 242M, and the image in the boundary is smoothly connected in the width direction.

When the halftone image data after the halftone process and the halftone image data after the dividing process are stored in the storage 44 in advance, the process in step S201 and step S202 may be omitted.

The controller 40 determines whether the defective nozzle information is stored in the storage 44 (step S203). When the defective nozzle information is stored in the storage 44 ("YES" in step S203), the controller 40 performs the above-described complemented correction, the delay correction, and the shading correction on the halftone image data after dividing based on the defective nozzle information and stores the above in the storage 44 (step S204). With this, the divided halftone image data supplied to the 8 head modules 242M is completed.

When the defective nozzle information is not stored in the storage 44, that is, the defective nozzle detecting process is performed for the first time ("NO" in step S203), the controller 40 advances the process to the later-described step S206.

The controller 40 controls the image processor 51 to perform the dividing process on the 1 bit original image data of the defective nozzle specifying image 62 and generates the portion image data corresponding to each head module 242M (step S205). With this, the divided defective nozzle specifying image data supplied to the 8 head modules 242M is completed. When the defective nozzle specifying image data after the dividing process is stored in the storage 44 in advance, the process of step S205 may be omitted.

The controller 40 controls the image processor 51 to combine the halftone image data generated in the process up to step S204 with the defective nozzle specifying image data generated in step S205, generates the divided composite test image data supplied to the 8 head modules 242M, and stores the above in the storage 44 (step S206).

When the process in step S206 ends, the controller 40 ends the composite test image data generating process and returns to the defective nozzle detecting process.

The timing that the dividing process is performed on the halftone image data and the defective nozzle specifying image data is not limited to the above, and for example, the dividing process can be performed after the halftone image data and the defective nozzle specifying image data are combined.

Figure 7:
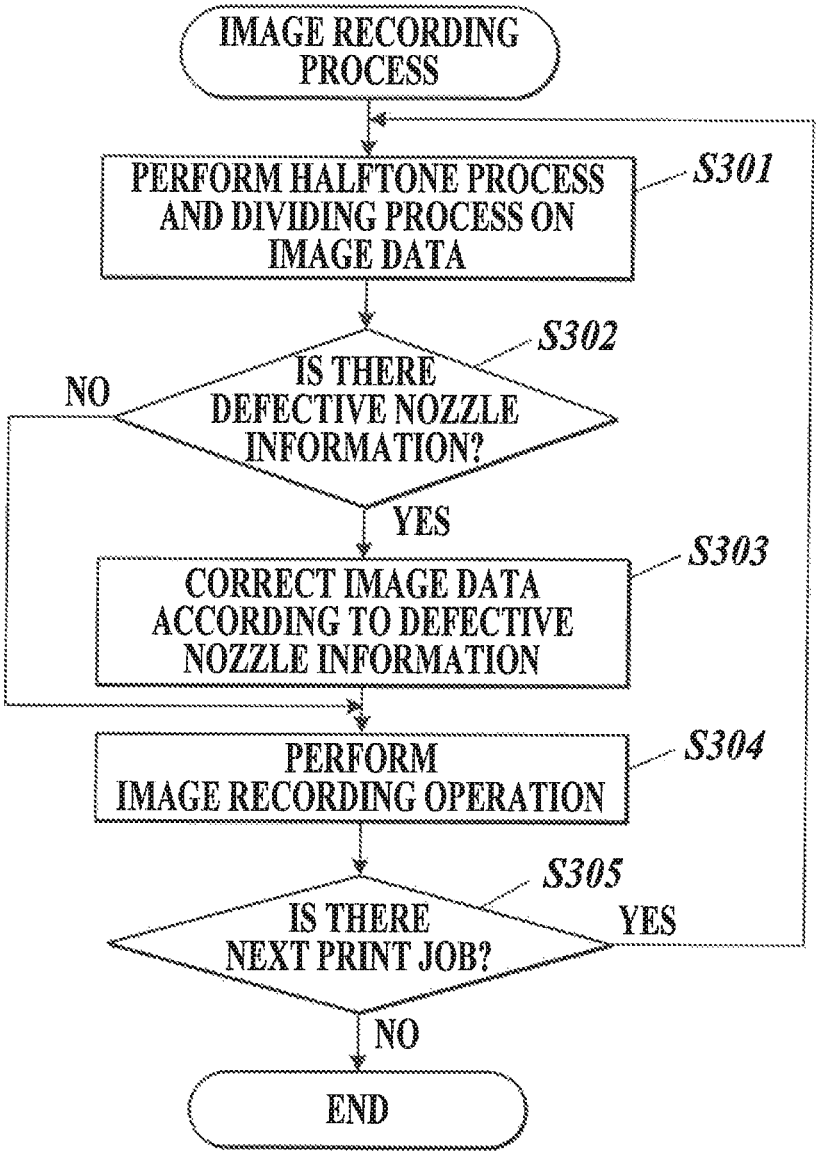
FIG. 7 is a flowchart showing a control process in an image recording process.

FIG. 7 is a flowchart showing a control process by the controller 40 in the image recording process.

The image recording process is performed when the print job and the image data of the normal image is input from the external apparatus 2 through the input/output interface 54 to the controller 40.

Before the image recording process is started, the controller 40 controls the conveying driver 52 to output the driving signal to the conveying drum motor of the conveying drum 211 to start the rotating operation of the conveying drum 211. When the image data for the print job is PDL (Page Description Language) data, the controller 40 outputs the control signal to the image processor 51 so that the image processor 51 converts the image data to image data in a rasterized form with 8 bits in each pixel.

When the image recording process starts, the controller 40 outputs the control signal to the image processor 51, and the image processor 51 performs the halftone process and the dividing process on the image data of the recorded normal image to generate the portion image data corresponding to each head module 242M (step S301). Here, the controller 40 controls the image processor 51 to perform the halftone process on the image data of the normal image using the same algorithm as the halftone process in step S201 in the composite test image data generating process.

The controller 40 determines whether the defective nozzle information is stored in the storage 44 (step S302). When it is determined that the defective nozzle information is stored in the storage 44 ("YES" in step S302), based on the defective nozzle information, the controller 40 performs the above-described complemented correction, delay correction and shading correction on the image data (portion image data) of the image in the print job and stores the result in the storage 44 (step S303).

When the process in step S303 ends, the controller 40 performs the image recording operation regarding the print job by the head unit 24 based on the corrected image data (step S304). That is, the controller 40 outputs a control signal to the conveying driver 52 in order to operate the sheet feeder 10, the transfer unit 22 and the conveyor 21 to place the recording medium P on the conveying surface of the conveying drum 211. The controller 40 controls the head controller 241 to supply the corrected image data stored in the storage 44 to the head driver 2421 at a suitable timing according to the rotation of the conveying drum 211 and controls the head unit 24 to discharge the ink on the recording medium P to record the image as the target of recording on the recording medium P. As a result, the ink discharge is adjusted by the complemented correction, the delay correction, and the shading correction, so that the image is recorded with suitable image quality.

When it is determined in step S302 that the defective nozzle information is not stored in the storage 44 ("NO" in step S302), the controller 40 does not perform the correction of the image data and performs the process in step S304.

The controller 40 determines whether there is a next print job (step S305). When there is the next print job ("YES" in step S305), the process advances to step S301.

When it is determined that the image recording operations in all of the print jobs are finished ("NO" in step S305), the controller 40 ends the image recording process.

As described above, the ink jet recording apparatus 1 according to the present embodiment includes a head unit 24 provided with a plurality of nozzles 243 to discharge ink and a controller 40. The controller 40 performs control to discharge ink on the recording medium P from the plurality of nozzles 243 of the head unit 24, and to record on the recording medium P using the head unit 24 a composite test image 60 including a halftone image 61 with a predetermined density and a defective nozzle specifying image 62 which specifies the defective nozzle with the ink discharge defect (recording controller). The controller 40 obtains information regarding the ink discharge defect from the nozzle 243 based on the density distribution of the halftone image 61 read from the imaged data of the composite test image 60, and specifies the defective nozzle based on the above information and the portion in the defective nozzle specifying image 62 of the imaged data of the composite test image 60 (defective nozzle specifier).

According to the above configuration, the ink discharge defect can be determined with high sensitivity based on the density distribution in the halftone image 61 with which the shade can be easily determined. With this, the information regarding whether there is the ink discharge defect and the range that the ink discharge defect is occurring can be obtained. In the state that it is determined in advance that there is a defective nozzle according to the information, the defective nozzle is detected based on the defective nozzle specifying image. With this, it is possible to prevent the defective nozzle not being detected. For example, when the nozzle in the imaged data is large, and it is difficult to accurately detect the defective nozzle from only the defective nozzle specifying image, the defective nozzle can be more suitably detected and specified.

According to the above configuration, the defective nozzle which is actually causing the color unevenness in the halftone image 61, that is, the defective nozzle which is surely causing the defect in the image quality in the recorded image can be specified. With this, it is possible to suppress problems such as the nozzle in which the ink discharge state is slightly changed and which does not influence the image quality of the recorded image from being detected as the defective nozzle.

Since the halftone image 61 and the defective nozzle specifying image 62 are recorded in the same composite test image 60, the halftone image 61 and the defective nozzle specifying image 62 can be recorded by the nozzle 243 in substantially the same ink discharge state. With this, substantially, the same ink discharge state of each nozzle 243 is reflected in the halftone image 61 and the defective nozzle specifying image 62. Therefore, it is possible to suppress erroneous detection of the defective nozzle or not being able to detect the defective nozzle due to the influence of the ink discharge defect appearing in only one of the halftone image 61 or the defective nozzle specifying image 62.

Based on the density distribution of the halftone image 61, the controller 40 specifies the region of the color unevenness E as the recording defect portion in which the influence of the ink discharge defect from the nozzle 243 appears in the halftone image 61. The controller 40 specifies the defective nozzle from the nozzle 243 used in recording the portion corresponding to the color unevenness E in the defective nozzle specifying image 62 (defective nozzle specifier).

With this, the range of the nozzle 243 in which the ink discharge defect is occurring is limited in advance, and the defective nozzle is detected from the nozzles 243 in the limited range based on the defective nozzle specifying image 62. Therefore, it is possible to detect the defective nozzle more suitably and more efficiently and it is possible to prevent the defective nozzle from not being detected. It is also possible to reduce the burden of the process in the controller 40 regarding specifying the defective nozzle. The nozzle 243 which does not cause the color unevenness in the halftone image 61 is outside the target of the defective nozzle detection. Therefore, it is possible to suitably determine the normal nozzle. With this, it is possible to surely suppress problems such as the nozzle in which the ink discharge state is changed slightly such that this does not influence the image quality of the recorded image from being detected as the defective nozzle.

The controller 40 uses the head unit 24 to record the halftone image 61 and the defective nozzle specifying image 62 on one recording medium P (recording controller). With this, the halftone image 61 and the defective nozzle specifying image 62 can be recorded at a close timing during the term that the recording operation is performed on the recording medium P. Therefore, the halftone image 61 and the defective nozzle specifying image 62 are recorded within a term that the ink discharge state from the nozzle 243 does no change or changes slightly. With this, it is possible to suppress erroneous detection of the defective nozzle or not being able to detect the defective nozzle due to the influence of the ink discharge defect appearing in only one of the halftone image 61 or the defective nozzle specifying image 62.

After the controller 40 uses the head unit 24 to record on the recording medium P either one of the halftone image 61 or the defective nozzle specifying image 62, the controller 40 controls the recording so that the image other than the halftone image 61 and the defective nozzle specifying image 62 is not recorded and the other of the halftone image 61 or the defective nozzle specifying image 62 is recorded on the recording medium P (recording controller). With this, the halftone image 61 and the defective nozzle specifying image 62 are recorded in a shorter term, that is, a closer timing. Therefore, the change in the ink discharge state from the nozzle 243 within the recording term of the halftone image 61 and the defective nozzle specifying image 62 can be made smaller. With this, the erroneous detection of the defective nozzle and the defective nozzle not being detected can be prevented effectively.

The controller 40 uses the head unit 24 to record the halftone image 61 and then to record the defective nozzle specifying image 62 (recording controller). In the recording of the halftone image 61, ink is discharged in a certain amount or more and in an even amount by the ink discharge operation from each nozzle 243 of the head unit 24 performed many times. Therefore, the nozzles 243 are always in a state with a high burden applied. In the nozzle 243 in such state, the movement of the ink of the nozzle opening becomes unstable, and the ink discharge defect in the defective nozzle is easily reflected in the ink characteristic amount (for example, accuracy of the landing position, amount of the droplet, speed of the droplet) discharged from the nozzle. Therefore, by recording the defective nozzle specifying image 62 after recording the halftone image 61, the ink discharge defect is more clearly reflected in the line La in the defective nozzle specifying image 62. With this, the defective nozzle can be more suitably specified.

The halftone image 61 includes a plurality of halftone regions HT1 to HT4 with densities different from each other, and the controller 40 obtains information regarding the ink discharge defect based on the density distribution in each of the plurality of halftone images HT1 to HT4 (defective nozzle specifier). How easily the color unevenness E which occurs according to the ink discharge defect appears in the halftone image 61 is different depending on the halftone density. Therefore, the color unevenness E, that is, the ink discharge defect is detected from each of the halftone regions HT1 to HT4 with different densities. With this, it is possible to more accurately determine whether there is an ink discharge defect.

The halftone expression form in the halftone image 61 is a pseudo halftone form showing the halftone according to the number of dots formed by the ink discharge from the plurality of nozzles 243 for every unit area. According to such configuration, the tone can be expressed by an easy process which outputs the ink to selectively make a dot. When there is a shift in the position or an abnormality in the density according to the ink discharge defect in the occupied dot in the dot region, the tone in the dot region changes. Therefore, the color unevenness which can be easily identified occurs in the halftone image 61 when there is an ink discharge defect.

The ink jet recording apparatus 1 includes an image processor 51 which performs the predetermined halftone process (conversion process) which converts the input image data to image data in a pseudo halftone form. When the composite test image 60 is recorded, the controller 40 controls the head unit 24 to record the halftone image 61 on the recording medium P based on the halftone image data on which the predetermined halftone process is performed by the image processor 51. The controller 40 controls the head unit 24 to record the defective nozzle specifying image 62 on the recording medium P based on the defective nozzle specifying image data on which the predetermined halftone process is not performed (recording controller). According to such configuration, in the defective nozzle specifying image 62, the occupied dot in the dot region is not distributed and a predetermined sign corresponding to the nozzle (line La according to the present embodiment) can be recorded by discharging ink from a single nozzle 243. Therefore, the nozzle corresponding sign with which the ink discharge defect can be detected for each nozzle 243 and which are separated from each other can be recorded in the defective nozzle specifying image 62.

The controller 40 controls the head unit 24 to record the normal image as the target of recording on the recording medium P (recording controller), and the halftone expression form in the normal image is the same as the halftone expression form in the halftone image 61. With this, the influence of the ink discharge defect from the nozzle can be made to appear to the same degree in the normal image and the halftone image 61. That is, the recording can be performed so that when there is an ink discharge defect which causes the image quality defect in the normal image, the color unevenness due to the ink discharge defect occurs in the halftone image 61, and when there is no image quality defect in the normal image, the color unevenness does not occur in the halftone image 61. With this, it is possible to suitably detect without mistake whether or not there is the ink discharge defect which causes the image quality defect in the normal image based on the halftone image 61.

The controller 40 controls the head unit 24 to record on the recording medium P the normal image as the target of recording based on normal image data on which the predetermined halftone process is performed (recording controller). With this, it is possible to record the normal image with the influence of the ink discharge defect from the nozzle 243 appearing similar to the halftone image 61.

The ink jet recording apparatus 1 includes a conveyor 21 which conveys the recording medium P. The plurality of nozzles 243 are provided throughout a predetermined recording width in a width direction orthogonal to the conveying direction of the recording medium P by the conveyor 21. The defective nozzle specifying image 62 includes a plurality of lines La which are recorded by the ink discharge from each of the plurality of nozzles 243 to the conveyed recording medium P and which are separated from each other. With this, it is possible to easily record the line La in the defective nozzle specifying image 62 as the nozzle corresponding signs which can be used to detect the ink discharge defect for each nozzle 243 and which are separated from each other.

The controller 40 adjusts the ink discharge operation from the plurality of nozzles 243 by the head unit 24 based on the specified result of the defective nozzle (adjuster). With this, the influence of the ink discharge defect by the defective nozzle can be suppressed and the image can be recorded with suitable image quality.

The ink jet recording apparatus 1 includes the imager 26 which reads the composite test image 60, and therefore, the imaged data of the composite test image 60 can be generated in the ink jet recording apparatus 1.

The defective nozzle detection method of the present embodiment includes the following steps. According to the recording step, the ink is discharged from the plurality of nozzles 243 in the head unit 24 to the recording medium P and the head unit 24 records the composite test image 60 on the recording medium P. The composite test image 60 includes a halftone image 61 in a predetermined density, and a defective nozzle specifying image 62 to specify the defective nozzle in which the ink discharge defect is occurring. According to the defective nozzle specifying step, the information regarding the defect of the ink discharge from the nozzle 243 is obtained based on the density distribution of the halftone image 61 read from the imaged data of the composite test image 60. The defective nozzle is specified based on the information and the portion in the defective nozzle specifying image 62 in the imaged data of the composite test image 60.

According to such method, compared to detecting the defective nozzle based on either of the halftone image 61 or the defective nozzle specifying image 62, it is possible to detect and specify the defective nozzle more suitably.

The present invention is not limited to the above embodiments and various changes can be made.

For example, according to the present embodiment, one recording medium P is used and only the composite test image 60 is recorded on the recording medium P. Alternatively, the normal image can be recorded together with the composite test image 60 on the recording medium P.

According to the present embodiment, a paper in a sheet is used as the recording medium P, but the recording medium P can be a continuous report sheet or a long sheet such as roll sheet supplied in a roll to roll format. In this case, a plurality of recording ranges are set in the recording medium and the composite test image 60 is recorded in one recording range.

According to the present embodiment, 4 halftone regions HT1 to HT4 are included in the halftone image 61, but the present invention is not limited to the above. For example, the number of halftone regions can be 5 or more or 3 or less. Therefore, the halftone image 61 can include only 1 halftone region. The halftone image 61 may include the halftone regions in a plurality of colors recorded by the plurality of head units 24 corresponding to each of the plurality of colors.

According to the present embodiment, the defective nozzle specifying image 62 includes the line La and the reference line Lb, but the present invention is not limited to the above. The defective nozzle specifying image 62 is to include the nozzle corresponding signs which are recorded by each nozzle 243 and which are separated from each other, and for example, a dot pattern can be recorded instead of the line La. The reference line Lb can be omitted depending on the desired detection accuracy of the ink discharge defect and the type of defect as the detected target.

The halftone image 61 can be recorded in the recording medium P (for example, margin region) in which the normal image is recorded but the composite test image 60 is not recorded. In this case, when the halftone image 61 of the recording medium P is imaged by the imager 26 and the color unevenness is detected from the imaged data, the recording of the normal image is paused, and the composite test image 60 can be recorded on the next recording medium P to perform the detection operation of the defective nozzle according to the present embodiment. With this, it is possible to suppress the number of times that the composite test image 60 is recorded to a minimum amount that is necessary, and it is possible to suppress the reduction of the recording efficiency of the normal image.

According to the present embodiment, the ink discharge operation is adjusted by the nozzle 243 by performing correction processes such as the complemented correction, the delay correction and the shading correction according to the specified result of the defective nozzle. Instead of the above, the result specifying the defective nozzle can be displayed on the operation unit/display 53 or a predetermined notification can be made by a notification unit which is not shown.

According to the present embodiment, the ink jet recording apparatus 1 includes an image processor 51 as the image processor and the halftone process and the dividing process are performed by the image processor 51. Alternatively, the various processes by the image processor 51 can be performed by the controller 40.

Various correction processes such as the complemented correction, the delay correction and the shading correction can be performed by the image processor 51.

According to the present embodiment, the ink jet recording apparatus 1 includes an imager 26 but instead of the above, the imaged data can be generated by imaging the composite test image 60 with an imaging apparatus provided separately outside the ink jet recording apparatus 1.

According to the present embodiment, the recording medium P is conveyed by the conveying drum 211, but the present invention is not limited to the above. For example, the recording medium P can be conveyed by the conveying belt which is supported by two rollers and which moves according to the rotation of the roller.

According to the present embodiment, the ink jet recording apparatus 1 in a single pass method is described, the present invention can be applied to the ink jet recording apparatus which performs recording on the image by scanning using the recording head.

Various embodiments of the present invention are described but the scope of the present invention is not limited to the embodiments described above, and includes the scope as described in the attached claims and its equivalents.

Although embodiments of the present invention have been described and illustrated in detail, the disclosed embodiments are made for purposes of illustration and example only and not limitation. The scope of the present invention should be interpreted by terms of the appended claims.

INDUSTRIAL APPLICABILITY

The present invention can be used in an ink jet recording apparatus and in a method for detecting a defective nozzle.

DESCRIPTION OF REFERENCE NUMERALS

1 ink jet recording apparatus
2 external apparatus
10 sheet feeder
11 sheet feeding tray
12 medium supplier
20 image recorder
21 conveyor
211 conveying drum
22 transfer unit
23 heater
24 head unit
241 head controller
242 recording head
242M head module
2421 head driver
243 nozzle
25 fixer
26 imager
261 imaging controller
262 line sensor
27 delivering unit
30 sheet ejector
31 sheet ejecting tray
40 controller
41 CPU
42 RAM
43 ROM
44 storage
51 image processor
52 conveying driver
53 operation unit/display
54 input/output interface
55 bus
60 composite test image
61 halftone image
62 defective nozzle specifying image
HT1 to HT4 halftone region
La line
Lb reference line
P recording medium

The invention claimed is:

1. An ink jet recording apparatus comprising:

an ink discharger provided with a plurality of nozzles which discharge ink; and a processor, wherein, the processor discharges ink onto a recording medium from the plurality of nozzles of the ink discharger, and uses the ink discharger to record on the recording medium a composite test image including a halftone image with a predetermined density and a defective nozzle specifying image which specifies a defective nozzle in which a defect in ink discharge is occurring; and the processor obtains information to specify a recording defect portion appearing in the halftone image due to an influence of the defect in the ink discharge from the defective nozzle based on a density distribution of the halftone image read from read data of the composite test image, and the processor specifies the defective nozzle from the nozzles used in recording a portion corresponding to the recording defect portion in the defective nozzle specifying image.

2. The ink jet recording apparatus according to claim 1, wherein the processor uses the ink discharger to record the halftone image and the defective nozzle specifying image in one recording range on the recording medium.

3. The ink jet recording apparatus according to claim 1, wherein, after the processor uses the ink discharger to record either one of the halftone image or the defective nozzle specifying image on the recording medium, the processor does not allow the ink discharger to record the image other than the halftone image and the defective nozzle specifying image and the processor uses the ink discharger to record the other of the halftone image or the defective nozzle specifying image on the recording medium.

4. The ink jet recording apparatus according to claim 1, wherein the processor uses the ink discharger to record the defective nozzle specifying image after recording the halftone image.

5. The ink jet recording apparatus according to claim 1, wherein the halftone image includes a plurality of halftone regions with densities different from each other and the processor obtains information regarding the defect in the ink discharge based on a density distribution in each of the plurality of halftone image regions.

6. The ink jet recording apparatus according to claim 1, wherein a halftone expression form in the halftone image is a pseudo halftone form expressing halftone according to the number of dots formed by ink discharged from the plurality of nozzles for each unit area.

7. The ink jet recording apparatus according to claim 6, further comprising an image processor which performs a predetermined conversion process to convert input image data to image data in the pseudo halftone form, wherein, in the composite test image recording, the processor uses the ink discharger to record on the recording medium the halftone image based on the halftone image data on which the image processor performed the predetermined conversion process and the processor uses the ink discharger to record on the recording medium the discharge nozzle specifying image based on the defective nozzle specifying image data on which the predetermined conversion process is not performed.

8. The ink jet recording apparatus according to claim 7, wherein the processor uses the ink discharger to record on the recording medium the normal image as the target of recording based on normal image data on which the predetermined conversion process is performed.

9. The ink jet recording apparatus according to claim 1, wherein, the processor uses the ink discharger to record on the recording medium a normal image as a target of recording; and the halftone expression form in the normal image is the same halftone expression form as the halftone image.

10. The ink jet recording apparatus according to claim 1, further comprising a conveyor which conveys the recording apparatus, wherein, the plurality of nozzles are provided throughout a predetermined recording width in a width direction orthogonal to a conveying direction of the recording medium conveyed by the conveyor; and the defective nozzle specifying image includes a plurality of nozzle corresponding signs which are recorded on the conveyed recording medium by ink discharge from each of the plurality of nozzles and which are separated from each other.

11. The ink jet recording apparatus according to claim 1, wherein the processor adjusts operation of ink discharge from the plurality of nozzles performed by the ink discharger based on a result of specifying a defective nozzle.

12. The ink jet recording apparatus according to claim 1, further comprising a reader which reads the composite test image.

13. The ink jet recording apparatus according to claim 1, wherein the defective nozzle specifying image comprises a plurality of lines, each of which is recorded by discharging ink continuously from one of the nozzles.

14. The ink jet recording apparatus according to claim 13, wherein the ink jet recording apparatus is configured to specify a region of color unevenness based on the density distribution of the halftone image to determine whether there is the defective nozzle and then to analyze the lines of the defective nozzle specifying image corresponding to the region.

15. The ink jet recording apparatus according to claim 1, wherein the ink jet recording apparatus is configured to record the halftone image with a correction process to suppress a decrease in an image quality due to a defective nozzle previously detected and to record the defective nozzle specifying image without preforming the correction process.

16. A method for detecting a defective nozzle in an ink jet recording apparatus including an ink discharger provided with a plurality of nozzles which discharge ink, the method comprising:

discharging ink onto a recording medium from the plurality of nozzles of the ink discharger, and using the ink discharger to record on the recording medium a composite test image including a halftone image with a predetermined density and a defective nozzle specifying image which specifies a defective nozzle in which a defect in ink discharge is occurring; and obtaining information to specify a recording defect portion appearing in the halftone image due to an influence of the defect in the ink discharge from the defective nozzle based on a density distribution of the halftone image read from read data of the composite test image, and specifying the defective nozzle from the nozzles used in recording a portion corresponding to the recording defect portion in the defective nozzle specifying image.

* * * * *